United States Patent [19]

Osterle et al.

[11] 4,068,790

[45] Jan. 17, 1978

[54] POWER CONTROL ARRANGEMENT FOR AN EXPLOSIVE POWDER-DRIVEN SETTING GUN

[75] Inventors: Helmut Österle, Nofels; Herbert Rangger, Frastanz, both of Austria

[73] Assignee: Hilti Aktiengesellschaft, Schaan, Liechtenstein

[21] Appl. No.: 735,093

[22] Filed: Oct. 22, 1976

[30] Foreign Application Priority Data

Oct. 27, 1975 Germany ..... 2548014

[51] Int. Cl.[2] ..... B25C 1/14

[52] U.S. Cl. ..... 227/8; 227/10

[58] Field of Search ..... 227/8, 10, 11

[56] References Cited

U.S. PATENT DOCUMENTS

| | | | |
|---|---|---|---|
| 2,970,314 | 2/1961 | Temple et al. | 227/8 |
| 3,659,768 | 5/1972 | Brunelle | 227/10 |
| 3,746,235 | 7/1973 | Crabtree, Jr. | 227/10 |
| 3,899,113 | 8/1975 | Brack | 227/10 |
| 3,973,708 | 8/1976 | Scotoni | 227/10 |

*Primary Examiner*—Granville Y. Custer, Jr.

*Attorney, Agent, or Firm*—Toren, McGeady and Stanger

[57] ABSTRACT

In an explosive powder-driven setting gun in which a piston guide is axially displaceable within a casing and a driving piston is axially displaceable within the piston guide, a stop pin is provided for varying the volume of the combustion gases within the piston guide at the rear end of the driving piston. The stop pin extends between a locking piece in the rear end of the casing, through the rear end of the piston guide into contact with the rear end of the driving piston. An adjustable stop surface for the stop pin can be provided integrally with the locking piece, or as a separate member movably mounted in the locking piece. By adjusting the stop surface the spacing between the rear end of the driving piston and the rear end of the piston guide is determined for establishing the initial size of the combustion chamber for the explosive gases which propel the driving piston.

10 Claims, 7 Drawing Figures

POWER CONTROL ARRANGEMENT FOR AN EXPLOSIVE POWDER-DRIVEN SETTING GUN

SUMMARY OF THE INVENTION

The present invention is directed to an explosive powder-driven setting gun including a piston guide containing a driving piston, both of which are axially displaceable relative to a locking piece and, more particularly, it concerns an axially adjustable stop pin located in the rear end of the piston guide and disposed in parallel relation with the axis of the driving piston for limiting the rear position of the piston.

Such setting guns are generally used for different purposes. Therefore, it is necessary to adapt the driving energy developed within the gun to the changing conditions. Accordingly, it has been found to be expedient to vary the size of the initial combustion chamber within the setting gun. This is done, for example, in that the rear starting position of the driving piston is determined by striking against a stop which defines, depending on the adjustment, the firing position of the driving piston in one position of the piston guide.

In a known setting gun, the stop pin is screwed into the piston gun to obtain such a power control with the end of the pin extending into the bore within the piston guide and acting as a rear stop for the driving piston, while the piston guide projects rearwardly and is designed as a control knob for facilitating the rotation of the stop pin. By turning the knob, the stop pin is displaced axially so that the position of the end of the pin extending into the piston guide bore defines the firing position of the driving piston, that is, it determines the size of the initial combustion space which determines the variable power of the setting gun.

One notable disadvantage of this design is that both the screw coupling of the stop pin and the piston guide and the threaded section of the pin extending into the piston guide are directly exposed to the explosive gases and thus to the powder residues. The powder residues become deposited on the threads and after a relatively short period of time, adjustment of the stop pin becomes impossible.

Further, the thread on the stop pin is also exposed to great mechanical stress, since the stop pin must absorb the entire return force of the driving piston when it is displaced rearwardly into the firing position. Furthermore, it has been found that when the driving piston is pushed too rapidly back into the piston guide that it rebounds from the stop pin for an undetermined distance. Such rebounding prevents any exact adjustment of the driving power. Additionally, in this type of adjustment of the initial combustion space, the bore of the piston guide becomes greatly fouled in the range of the initial combustion space, since the driving piston can be pushed rearwarly only until it bears on the stop pin. The powder residues formed during each firing step can settle in the bore and such residue settlement results in an undesired reduction in the volume of the initial combustion space. Therefore, the problems for which the present invention provides a solution is to provide a setting gun with an exactly adjustment power control which is insensitive to fouling. In accordance with the present invention, the problem is solved by providing a stop pin which is freely axially displaceable relative to the piston guide and by providing a supporting element for the stop pin which is located in the locking piece.

In setting guns with driving pistons, after the gun is fired, it is necessary to return the driving piston from a forward position in the piston guide back to a rear position where it is ready for another driving operation. Usually the rearward movement of the driving piston is carried out by pulling the piston guide forwardly in the gun case with a stopper at the casing end extending behind the driving piston for effecting displacement of the driving piston relative to the piston guide. Due to the free displaceability of the stop pin relative to the piston guide, the driving piston bearing on the supporting element is displaced in the end phase of the displacement process of the piston guide toward the driving piston and thus determines the size of the initial combustion chamber by moving the driving piston forwardly within the piston guide.

As a result, the stop pin can be displaced in practically any setting relative to the piston guide, so that powder residues cannot settle between the stop pin and the piston guide. The constant back-and-forth movement of the stop pin results effectively in self-cleaning.

Further, the section of the bore of the piston guide in which the initial combustion space is provided, is also cleared after each return of the piston guide to the firing position, since the driving piston, due to the free axial displaceability of the stop pin, always moves into the rearmost position when the barrel is moved forwardly, thus removing any powder residues.

Because the stop pin axially displaces the driving piston from its rearmost position within the piston guide into the firing position only during the last phase of the rearward movement of the piston guide, there is the advantage that, on the one hand, only an extremely low mechanical stress is exerted on the stop pin, and on the other hand, rebounding of the driving piston into an undetermined position is prevented.

Further, in accordance with the present invention, it is also possible to use another type of stop element instead of the stop pin, for example, a latch.

According to one embodiment of the invention, the supporting element for the stop pin can be integral with the locking piece. It is advisable if the end face of the locking piece facing the piston guide is designed as the supporting element.

For adjusting the setting gun for different power levels, stop pins of different lengths can be used and such an arrangement is particularly advantageous in setting guns which only rarely require power adjustment because of few changes in the operating conditions.

Furthermore, the supporting elements can be arranged as a stepped or planar ramp formed in the end face of the locking piece directed toward the piston guide. If this ramp or stop surface extends along a circular path, the striking plane for the stop pin can be adjusted by turning or rotating the locking piece about an axis extending in the axial direction of the driving piston.

Preferably, the supporting element is adjustable relative to the locking piece. In such an arrangement, by varying the position of the supporting element, the striking plane for the stop pin can be varied without any change in the position of the locking piece.

It has been found to be simple and expedient to form the supporting element as a threaded pin. In this way a large continuous adjustment range of the striking plane for the stop pin is attained. In addition, the threaded pin can project rearwardly from the casing for permitting easy adjustment of the combustion space from the exterior of the gun casing.

It is preferably if the threaded pin is formed integrally with the stop pin with the threaded pin being secured in the locking piece and with the stop pin projecting from the locking piece toward the driving piston. The stop pin traverses the rear end of the piston guide when the guide is in its rearward or firing position. When the piston guide is displaced forwardly, the stop pin becomes disengaged. It has been found that the integral design of the thread pin and stop pin is extremely insusceptible to trouble.

If an axially shortened setting gun is desired, it is advantageous to use a laterally projecting adjustable supporting element with a variable stop surface extending in the axial direction of the stop pin. The stop surface can be an inclined ramp or a stepped ramp, such as set wheel or a slide.

To increase the self-cleaning effect of the stop pin, the pin can be provided with alternating lands and grooves, with the grooves forming circumferentially extending constrictions. These constrictions are preferably arranged for passage through the rear end of the piston guide.

It has also been found advantageous and effective to construct the transition between the lands and the grooves to provide a plurality of sharp edges on the stop pin.

The various features of novelty which characterize the invention are pointed out with particularity in the claims annexed to an forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figures 1, 2:
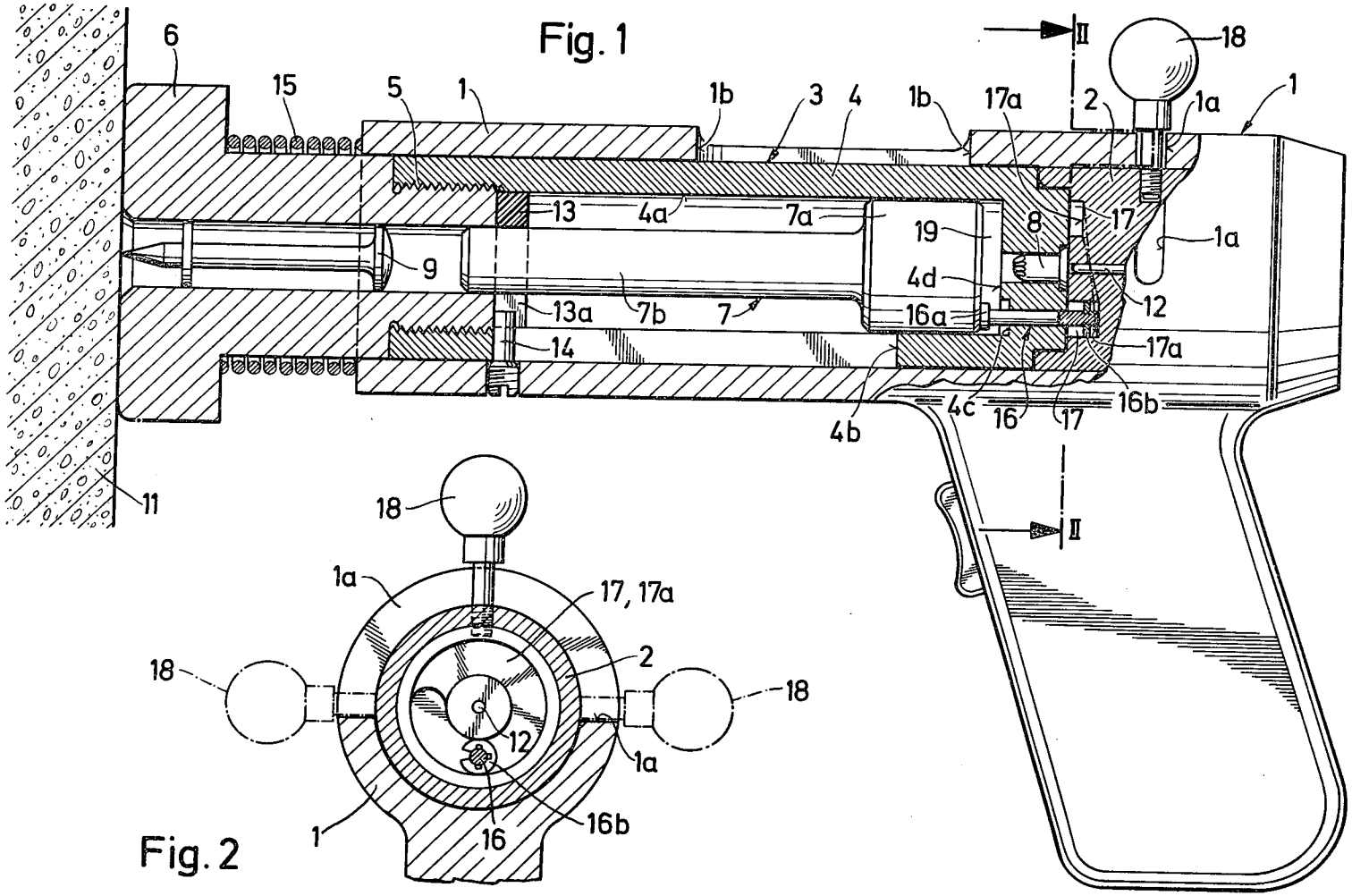
FIG. 1 is a side view, partly in section, of a setting gun embodying the present invention, with the gun shown in position ready to be fired.
FIG. 2 is a sectional view taken along the line II—II of FIG. 1.

In FIG. 1 an explosive powder-driven setting gun is illustrated including a casing 1 having a front or muzzle end and a rear end to which a handle is attached. The casing 1 forms an axially extending bore between the front and rear end with a locking piece 2 positioned in the rear end. The locking piece being stationary in the axial direction of the bore but rotatable about the axis of the bore. Arranged within the bore in the casing forwardly of the locking piece 2 is a piston guide 3 which is axially displaceable within the casing. The piston guide 3 is constructed in two parts for assembly reasons, that is, a rear cylinder 4 and a muzzle part 6 connected together over a threaded section 5 on each. Arranged within the piston guide is an axially displaceable driving piston 7. A cartridge 8 mounted in a chamber in the rear end of cylinder 4 provides the explosive gases for propelling the driving piston against a nail 9 inserted into the muzzle part 6. The piston drives the nail 9 from the muzzle part 6 into a receiving material 11. Ignition of the cartridge 8 is effected by a firing pin 12 which is part of a known mechanically operated firing mechanism, and, accordingly, is not further illustrated or described. The cylinder 4 forms an axially extending bore **4*a* having an elastic stop ring 13 near its forward end so that it bears against the rearward end of the muzzle part 6. Stop ring 13 prevents a hard impact of the piston head 7*a* on the rear end of the muzzle part 6 in case there is any excess energy generated in the firing action, thereby preventing any damage to the piston head. As can be noted in FIG. 1, the stop ring 13 has a slot 13*a* into which a stopper 14 projects. The stopper 14 is screwed into the casing and extends inwardly into the slot 13*a*. Further, the stopper 14 traverses an axially or longitudinally extending slot 4*b* of cylinder 4**.

Located between the front end of the casing 1 and a shoulder formed on the muzzle part 6 is a compression spring 15 which biases the piston guide 3 in the driving direction. In FIG. 1, the setting gun is in the ready to be fired position with the driving piston 7 in its rear position within the piston guide and with the rearwardly facing surface of the piston head **7*a* bearing against the forward end surface of a stop pin 16. Stop pin 16 is mounted in the rear end of piston guide 3 for free axial movement relative to the piston guide. Further, the stop pin extends rearwardly from the piston guide and has its rearward end in contact with a supporting element in the form of a circular groove 17 provided in the face of the locking piece 2 directed toward the driving piston. The bottom or stop surface 17*a* of the groove 17 provides an inclined supporting plane for the rear end of the stop pin. In other words, the stop surface 17*a* is located in a plane inclined at an angle to a plane extending perpendicularly across the axis of the driving piston. By rotating locking piece 2 by means of a screwed-in control knob 18, the supporting position for stop pin 16 can be selected and the desired volume of the initial combustion space 19 located rearwardly between the rearward face of the piston head 7*a* and the rearward end of the piston guide can be established. Variations in the volume of the initial combustion space 19 are achieved by turning the control knob 18 and with it the locking piece 2 for locating a selected portion of the stop surface 17*a* in alignment with the stop pin 16**.

To permit turning of the control knob 18 relative to the casing 1, a slot **1*a* is formed in the casing extending transversely of the axial direction of the driving piston. To prevent stop pin 16 from being displaced out of the piston guide 3, the front end of the stop pin is provided with a flange 16*a* and its rear end with a locking washer 16*b*. A recess in the forwardly facing surface of the rear end of the piston guide 3 is provided by a countersunk portion 4*c* in the rear end of the cylinder 4. An ejection opening 1*b* is provided in the upper portion of the casing 1 for introducing and removing cartridges 8** from the setting gun.

In FIG. 2 the casing 1 is shown with the locking piece 2 rotatably mounted within it. As indicated above, rotation of the locking piece relative to the casing is effected by the control knob 18 in the range of the transverse slot 1*a* with the extreme angularly spaced positions of the control knob being indicated by broken lines. This figure also shows the circular groove 17 and its bottom or stop surface 17*a* with the stop pin 16 engaged within the groove. The locking washer 16*b* is shown mounted on the stop pin 16 and the firing pin 12 can also be noted within the center of the locking piece.

In FIGS. 1 and 2 the muzzle part 6 of the setting gun is shown pressed against the receiving material 11 so that the compression spring is compressed against the front end of the casing 1. When the cartridge 8 is fired, the gases generated in the initial combustion space 19 propel the driving piston 7 forwardly so that piston shank 7*b* rides forwardly within the muzzle part 6 striking the nail 9 and driving it into the receiving material 11. At the completion of this propelling operation, the driving piston is in a front position within the piston guide and its piston head 7*a* stops in the range of stop ring 13.

Figure 3:
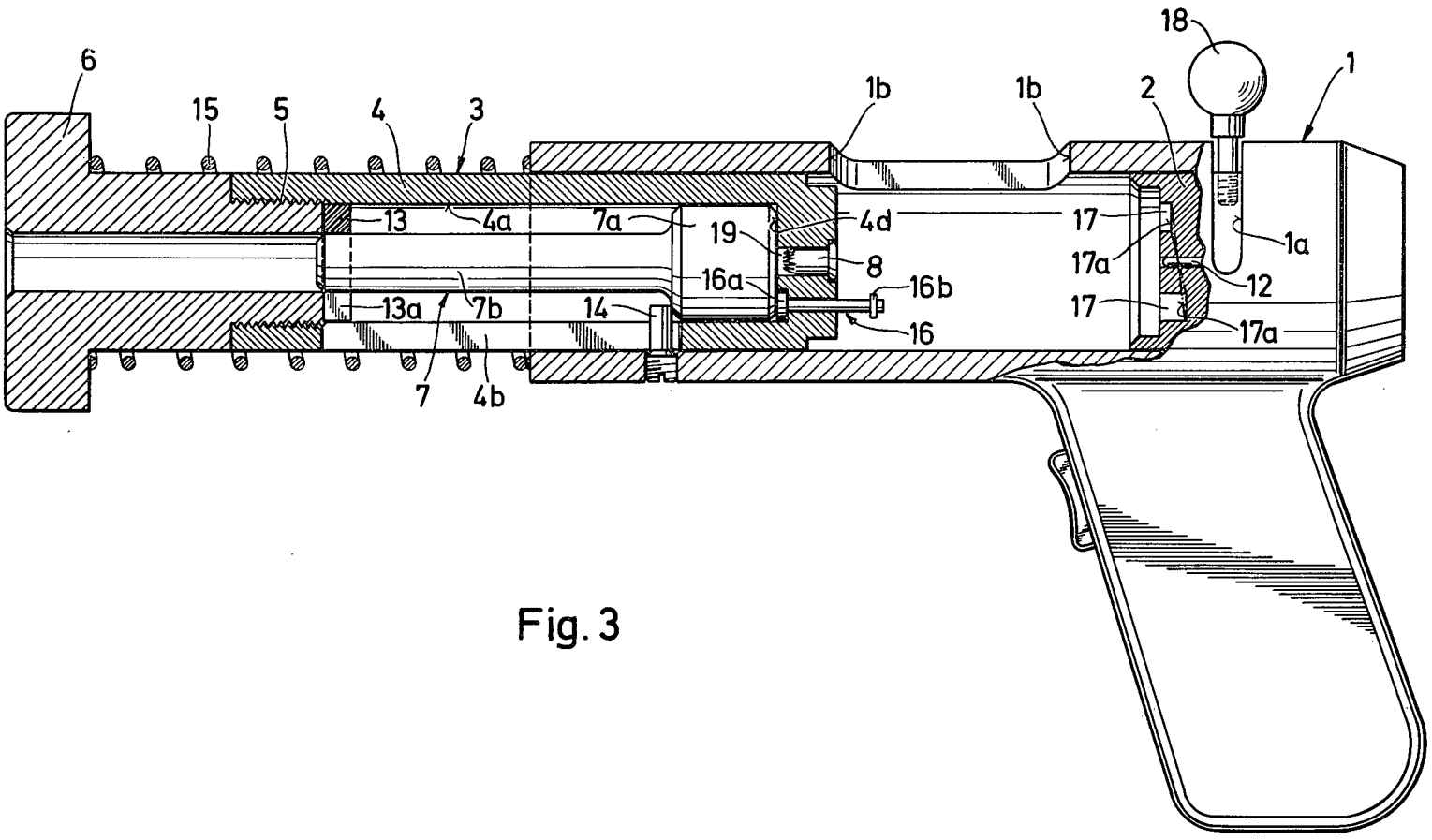
FIG. 3 is a view similar to that shown in FIG. 1 but illustrating the setting gun in the fired position with a cartridge in the cartridge chamber but without a nail or stud in the muzzle end of the gun.

With the nail 9 driven into the receiving material 11, the setting gun is removed from the receiving material and the compression spring biases the piston guide 3 forwardly so that the gun is placed in the rest or fired position shown in FIG. 3. When the piston guide is biased forwardly by the spring 15, the driving piston is prevented from following the movement of the piston guide, because its piston head 7*a* contacts the stopper 14 and cannot move in the forward or driving direction. As a result, driving piston 7 moves rearwardly within piston guide 3 until the rear end face of piston head 7*a* strikes against the end face 4*d* within the cylinder 4. As the piston head 7*a* moves into contact with the bottom 4*d*, it also displaces the stop pin 16 in the rearward direction into the represented rearmost position and any powder residues deposited in the rearward end of the piston guide are removed by the rearward movement of the stop pin 16 and the driving piston 7. Stopper 14 cooperating with piston 7*a* and the bottom 4*d* of the cylinder 4 also serves as a limiting stop during the advance movement of the piston guide. Additionally, stopper 14 prevents rotation of piston 3, since it is engaged within the longitudinal slot 4*b* in the cylinder 4 of the piston guide 3.

When the setting gun is again pressed against the receiving material 11, the piston guide 3 is displaced, together with the driving piston 7 and the stop pin 16 toward the locking piece 2. However, before piston guide 3 contacts the face of the locking piece directed toward the driving piston, the rear end of stop pin 16 strikes against the stop surface 17*a* of groove 17 causing the stop pin to be displaced forwardly relative to the piston guide 3 with its front end contacting the rear face of the piston head 7*a* and displacing the driving piston from contact with the bottom 4*d* into the position shown in FIG. 1, that is, with the rear face of the piston head 7*a* spaced forwardly of the bottom 4*d*. Accordingly, the initial combustion space 19 is increased. Depending on the distance through which the driving piston is to be displaced within piston guide 3, the corresponding depth of groove 17 is adjusted as a support for the rear end of stop pin 16 by turning control knob 18 and rotating the locking piece relative to the casing 1.

Figures 4, 5:
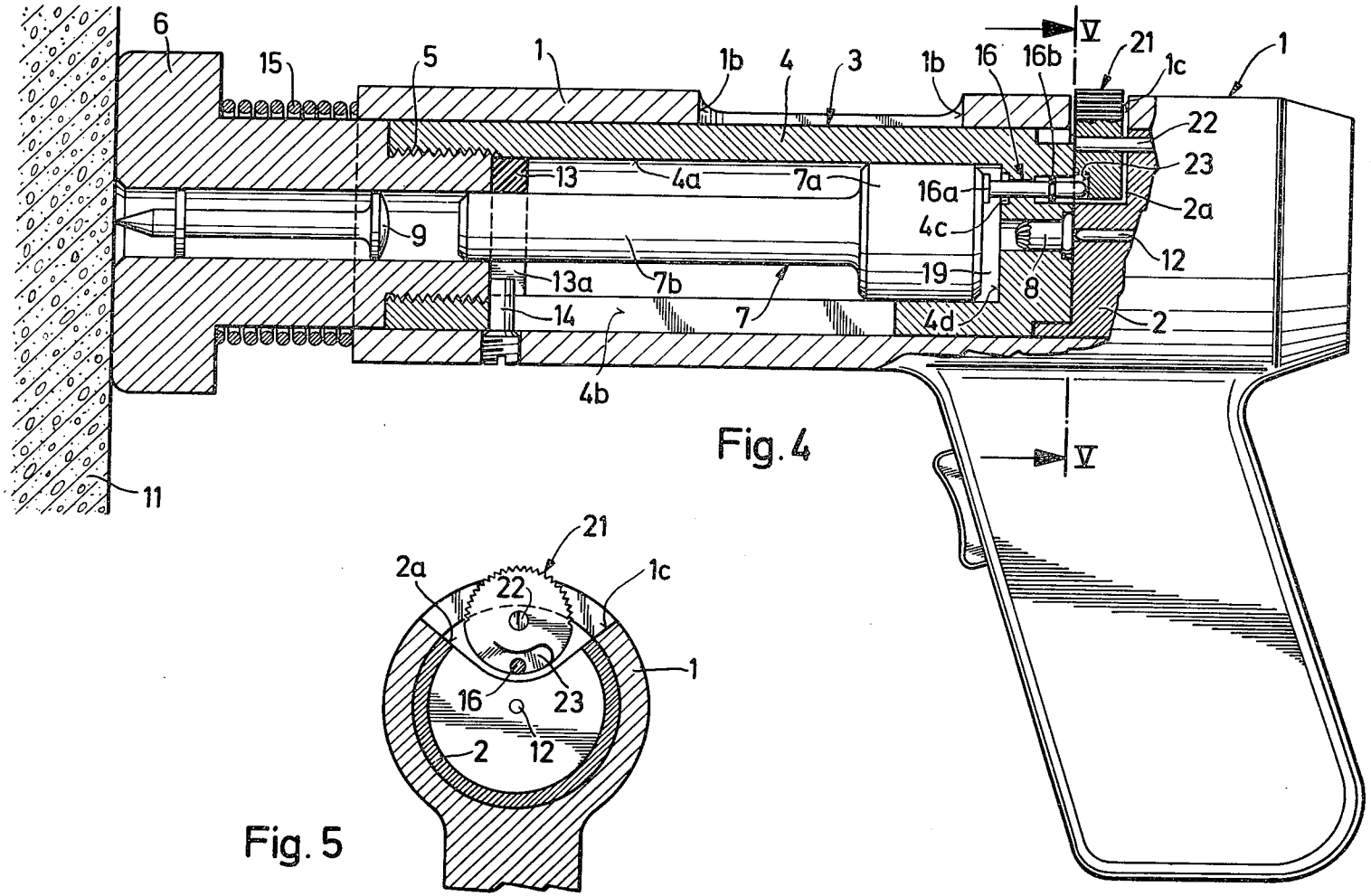
FIG. 4 is a view of a setting gun, similar to that shown in FIG. 1, but illustrating a different embodiment of the invention.
FIG. 5 is a sectional view taken along the line V—V of FIG. 4.

In FIG. 4, the setting gun corresponds substantially to the one shown in FIG. 1, however, the supporting element is provided as a separate member, that is, as a set wheel 21 projecting laterally upwardly from casing 1. The set wheel 21 is rotatably supported on a bearing pin 22 mounted in the locking piece 2. The portion of the set wheel against which the rear end of stop pin 16 bears is shaped as an inclined sliding ramp 23 similar to the arrangement shown in FIGS. 1, 2 and 3. Accordingly, by rotating set wheel 21 about bearing pin 22 the desired volume of the initial combustion space 19 can be established. As can be seen best in FIG. 5, the rotatability of the set wheel is provided by a transverse slot 1*c* in the casing and a corresponding guide slot 2*a* in the locking piece 2. This setting gun operates in the same manner as explained with regard to FIGS. 1, 2 and 3.

Figures 6, 7:
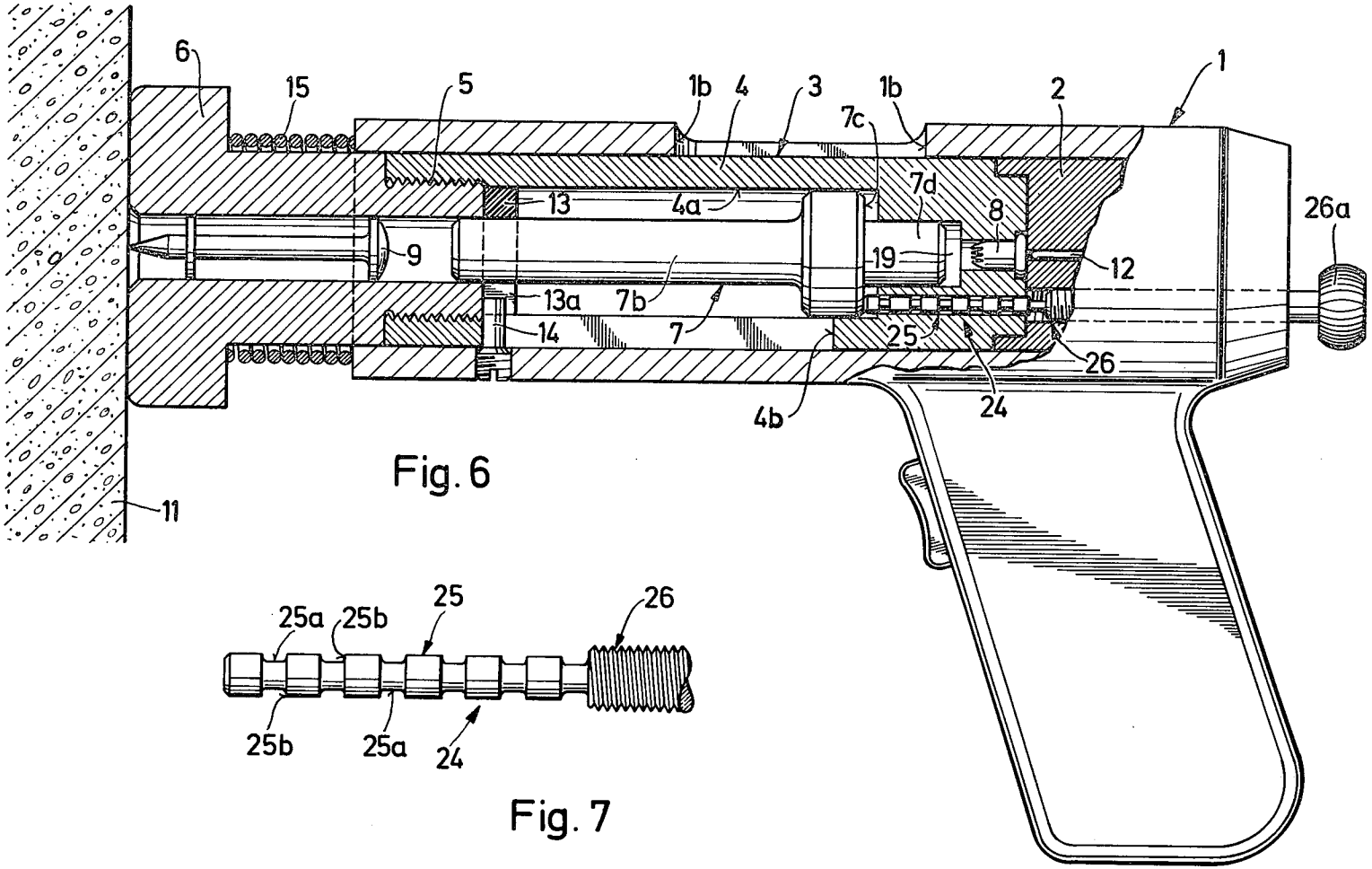
FIG. 6 displays a setting gun similar to that shown in FIG. 1 and illustrating still another embodiment of the invention.
FIG. 7 is an enlarged detailed illustration of the stop pin shown in FIG. 6.

In FIG. 6 another setting gun is shown constructed similar to those illustrated in FIGS. 1, 2 annd 3 and FIGS. 5 and 6 with one distinguishing feature being the adjustment of the volume of the initial combustion space 19 which is afforded by a control element 24. The control element 24 consists of an axially extending stop pin 25 which is formed integrally with a rear supporting element in the form of a threaded pin 26 in threaded engagement with the locking piece 2. The threaded pin projects rearwardly from the casing and has a control knob 26*a* on its rearward end so that it is accessible on the exterior of the casing.

Another distinguishing feature of the setting gun shown in FIG. 6 as compared to that in FIGS. 1 and 4 is in the shape of the driving piston 7 which has an enlarged portion close to the rearward end of the piston which forms a shoulder 7*c* and a cylindrical extension projecting rearwardly from the shoulder which extends into and is guided by a reduced diameter portion of the bore 4*a*. The initial combustion space 19 is provided within this reduced diameter bore portion. With this arrangement a tightly sealing and elongated guidance of stop pin 25 is provided within the rear end of the piston guide 3, that is, within the rear end formed by the cylinder 4. Turning control element 24 by means of the knob 26*a* permits adjustment of the axial position of the stop pin, so that, when the piston guide 3 returns toward the locking piece 2, stop pin 25 moves the driving piston 7 for a greater or lesser extent forwardly from the rear end of the bore 4*a* provided by its reduced diameter portion in which the extension 7*d* of the piston is seated.

As can be seen in FIG. 7, the stop pin 25 has alternating lands and grooves or circumferentially extending constrictions 25. The transition from the grooves 25*a* to the lands provide sharp edges 25*b*. This arrangement of stop pin 25 ensures, in its range of movement through the rear end of the piston guide 3, an improved self-cleaning effect of the stop pin and of the bore through which it passes. Naturally, the stop pin 16 can also be provided with the grooves or constrictions 25*a*to achieve the same effect.

While specific embodiments of the invention have been shown and described in detail to illustrate the application of the inventive principles, it will be understood that the invention may be embodied otherwise without departing from such principles.

What we claim is:

1. Explosive powder-driven setting gun comprising a casing forming an axially extending first bore having a muzzle end and a rear end spaced axially from the muzzle end, a piston guide axially displaceably mounted in the bore in said casing, said piston guide having a muzzle end and a rear end spaced axially from the muzzle end with the muzzle end of said piston guide oriented relative to one another in the same manner as the muzzle end and rear end of the bore in said casing, said piston guide forming a second bore with the axis thereof disposed in substantially parallel relation with the axis of the first bore, an axially elongated driving piston axially displaceable through the second bore in said piston guide between the rear end and muzzle end thereof, said driving piston having a forward end closer to the muzzle end of said piston guide and a rearward end closer to the rear end of said piston guide, a locking piece located within said casing at the rear end of the bore rearwardly of said piston guide, an axially displaceable stop pin mounted in the rear end of said piston guide and having the axis thereof disposed in parallel relation with the axis of said driving piston, said stop pin having a front end facing toward the muzzle end of said piston guide and a rear end facing in the opposite direction, wherein the improvement comprises that said locking piece being axially stationarily mounted in said casing, said stop pin being axially displaceable relative to said piston guide for locating the front end of said stop pin within the second bore in said piston guide to limit the position of the rear end of said driving piston relative to the rear end of said piston guide, and a supporting element for the rear end of said stop pin, said supporting element adjustably mounted in said locking piece and arranged for varying the extent to which said stop pin extends into the second bore in said said piston guide.

2. Explosive powder-driven setting gun, as set forth in claim 1, wherein said supporting element is formed integrally with said locking piece.

3. Explosive powder-driven setting gun, as set forth in claim 1, wherein said supporting element is an axially elongated pin threaded for a portion of its length and with the threaded portion disposed in threaded engagement with said locking piece and with the axis of said pin extending in substantially parallel relation with the axis of said driving piston.

4. Explosive powder-driven setting gun, as set forth in claim 3, wherein said threaded pin is formed integrally with said stop pin.

5. Explosive powder-driven setting gun, as set forth in claim 4, wherein said stop pin having alternating circumferentially extending lands and grooves.

6. Explosive powder-driven setting gun, as set forth in claim 5, wherein said grooves having transversely extending surfaces intersecting the circumferentially extending surfaces of said lands in sharp edges so that during relative movement of said piston guide and said stop pin the sharp edges effect a cleaning action.

7. Explosive powder-driven setting gun, as set forth in claim 1, wherein said supporting element includes a stop surface with said stop surface arranged for varying the extent said stop pin extends into said guide into contact with the rearward end of said piston.

8. Explosive powder-driven setting gun, as set forth in claim 7, wherein said stop surface extends transversely of the axial direction of said stop pin and extends angularly about an axis of rotation with the stop surface being located in a plane extending angularly to a plane disposed perpendicularly to the axial direction of said stop pin.

9. Explosive powder-driven setting gun, as set forth in claim 8, wherein said locking piece having a face extending transversely of the axis of said driving piston and directed toward the muzzle end of said casing, said locking piece being rotatably mounted in said casing about an axis coaxial with the axis of said driving piston, said supporting element comprising an arcuate groove formed in said face of said locking piece and being concentric with the rotation axis of said locking piece, said stop surface comprising the base of said arcuate groove.

10. Explosive powder-driven setting gun, as set forth in claim 9, wherein said casing having a cutout in the rear end thereof in the axially extending range of said locking piece, said locking piece having a cutout aligned with the cutout in said casing, said supporting element comprising a set wheel positioned in the cutouts in said casing and locking piece and rotatably mounted in said locking piece about an axis extending in parallel relation with the axis of said driving piston, said set wheel having a face extending transversely of the axis thereof with said face directed towards the muzzle end of said casing, said stop surface formed in said face of said set wheel and comprising an arcuate surface recessed in said face and concentric with the axis of said set wheel, said arcuate surface located in a plane disposed at an angle to a plane extending perpendicularly to the axis of said set wheel.

* * * * *